US007859490B2

(12) United States Patent
Oomori et al.

(10) Patent No.: US 7,859,490 B2
(45) Date of Patent: Dec. 28, 2010

(54) CURRENT DRIVE DEVICE

(75) Inventors: Tetsuro Oomori, Osaka (JP); Hisao Kunitani, Kyoto (JP); Hiroshi Kojima, Kyoto (JP); Makoto Mizuki, Kyoto (JP); Noriko Kaku, Kyoto (JP)

(73) Assignee: Panasonic Corporation, Osaka (JP)

( * ) Notice: Subject to any disclaimer, the term of this patent is extended or adjusted under 35 U.S.C. 154(b) by 1021 days.

(21) Appl. No.: 11/652,140

(22) Filed: Jan. 11, 2007

(65) Prior Publication Data

US 2007/0194814 A1 Aug. 23, 2007

(30) Foreign Application Priority Data

Jan. 11, 2006 (JP) ..... 2006-003390

(51) Int. Cl.
*G09G 3/30* (2006.01)

(52) U.S. Cl. ..... 345/76; 345/82; 323/312; 327/103

(58) Field of Classification Search ..... 345/76–83; 323/312–316; 327/103, 108, 540–543
See application file for complete search history.

(56) References Cited

U.S. PATENT DOCUMENTS 6,831,501 B1 * 12/2004 Aude ..... 327/538
6,859,193 B1 2/2005 Yumoto
7,161,412 B1 * 1/2007 Manganaro ..... 327/543
7,321,255 B2 * 1/2008 Maki ..... 327/538
7,391,193 B2 * 6/2008 Wang et al. ..... 323/282
7,417,461 B2 * 8/2008 Aoike ..... 326/82
7,474,131 B1 * 1/2009 Hoffmann et al. ..... 327/108
2004/0189275 A1 * 9/2004 Yoneyama ..... 323/315
2004/0227499 A1 * 11/2004 Date et al. ..... 323/315
2006/0007070 A1 1/2006 Shih
2006/0152461 A1 7/2006 Kida et al.

FOREIGN PATENT DOCUMENTS

JP 2004-198770 7/2004
JP 2005-049632 2/2005

* cited by examiner

*Primary Examiner*—Kimnhung Nguyen
(74) *Attorney, Agent, or Firm*—McDermott Will & Emery LLP

(57) ABSTRACT

The current drive device of the present invention includes: a current source transistor for allowing a preset drive current to flow to a drain; a cascode transistor cascode-connected to the current source transistor; a switch circuit for switching ON/OFF flow of the drive current through the drain of the cascode transistor and a circuit to be driven; and a bypass circuit for allowing the drive current to flow therethrough to bypass the switch circuit and the circuit to be driven when the switch circuit is OFF.

5 Claims, 6 Drawing Sheets

CURRENT DRIVE DEVICE

BACKGROUND OF THE INVENTION

1. Field of the Invention

The present invention relates to a current drive device that supplies drive currents to an apparatus to be driven such as an organic electroluminescence (EL) display panel, for example.

2. Description of the Prior Art

In organic EL panels and the like, for example, a current drive device that supplies currents corresponding to image data for respective pixels is used. As shown in FIG. 14 of Japanese Laid-Open Patent Publication No. 2005-49632, for example, this type of current drive device outputs drive currents corresponding to image data by allowing or blocking flows of mirror currents to current sources 1112 (n-type transistor) with corresponding switches 1115.

The above publication also suggests a technology in which cascode MISFETs 55 are provided, as shown in FIG. 6, to suppress the drain voltage of the current sources 1112 from varying to thereby enhance the precision of the drive currents.

However, even with the provision of the cascode MISFETs 55 as described above, the drain voltage of the current sources 1112 becomes close to the ground voltage (VSS) when the switches 1115 are turned off, and thereafter rises sharply when the switches 1115 are turned on. This variation in drain voltage affects the gate voltage via a gate-drain parasitic capacitance. Therefore, in this case, also, the precision of the drive currents will be degraded.

SUMMARY OF THE INVENTION

An object of the present invention is providing a current drive device that can output drive currents with enhanced precision.

The current drive device of the present invention includes: a current source transistor for allowing a preset drive current to flow to a drain; a cascode transistor cascode-connected to the current source transistor; a switch circuit for switching ON/OFF flow of the drive current through a drain of the cascode transistor and a circuit to be driven; and a bypass circuit for allowing the drive current to flow therethrough to bypass the switch circuit and the circuit to be driven when the switch circuit is OFF.

In the current drive device described above, the cascode transistor is connected to the current source transistor, and a current flowing to the current source transistor is diverted to the bypass circuit during the drive current stop period. This serves to keep the drain voltage of the current source transistor roughly constant, and thus suppress the gate voltage of the current source transistor from varying at the start of supply of the drive current. Hence, a high-precision drive current can be outputted.

The bypass circuit may include a bypass transistor connected to the drain of the cascode transistor at its source and receiving a predetermined fixed gate voltage at its gate, and the predetermined fixed gate voltage may be set so that the bypass transistor is ON with respect to a source voltage given when the switch circuit is OFF and OFF with respect to a source voltage given when the switch circuit is ON.

As described above, the gate voltage of the bypass transistor is set appropriately utilizing the fact that the voltage of the source of the bypass transistor, that is, the drain of the cascode transistor differs between during the drive current supply period and during the drive current stop period. With this setting, bypassing or not can be controlled without the necessity of changing the gate voltage.

The bypass circuit may include a bypass transistor connected to a drain of the current source transistor at its source and receiving a gate voltage equivalent to a gate voltage of the cascode transistor when the switch circuit is OFF.

As described above, the bypass transistor may be connected to the drain of the current source transistor by appropriately setting the gate voltage of the bypass transistor so as to provide the bypass transistor with substantially the same function as the cascode transistor. Hence, in this case, also, the precision of the drive current can be easily enhanced.

DESCRIPTION OF THE PREFERRED EMBODIMENTS

Hereinafter, preferred embodiments of the present invention will be described with reference to the accompanying drawings.

Embodiment 1

Figure 1:
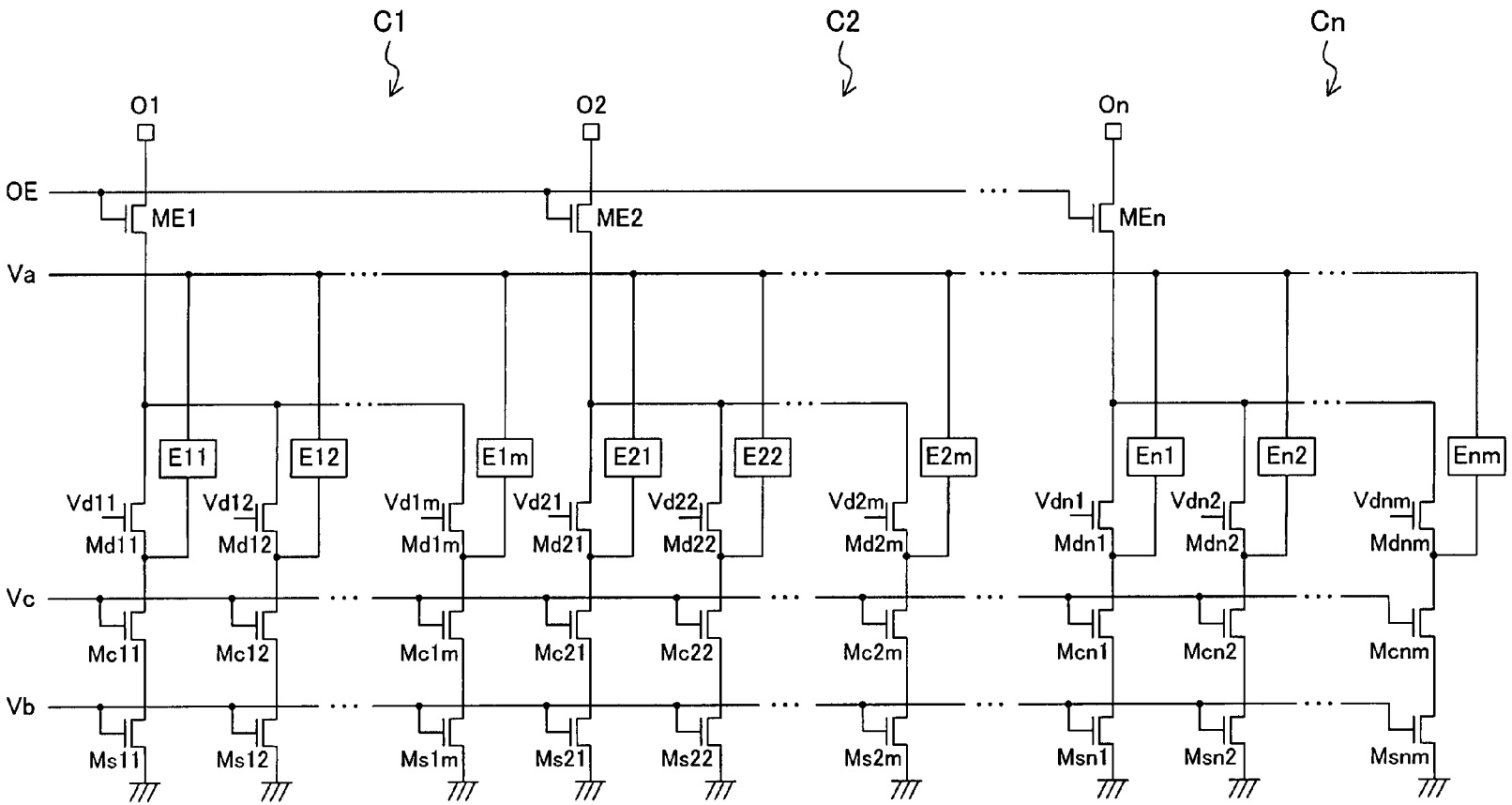
FIG. 1 is a circuit diagram of a current drive device of Embodiment 1.

As Embodiment 1, a current drive device that supplies currents corresponding to m-bit image data to n source lines of an electroluminescence (EL) display panel will be described. As shown in FIG. 1, this current drive device has n current output circuits C1 to Cn. In this embodiment, the current output circuits C1 to Cn are supposed to have the same configuration, and thus description will be made mainly focusing on the current output circuit C1 representatively. As for the other current output circuits C2 to Cn, components thereof having the same or similar functions as the counterparts of the current output circuit C1 are denoted by related reference numerals, and the description thereof is omitted appropriately. In the other embodiments to follow, also, components having the same or similar functions are denoted by related reference numerals, and the description thereof is omitted.

(Schematic Configuration)

The current output circuit C1 includes current source transistors Ms11 to Ms1*m*, cascode transistors Mc11 to Mc1*m* and individual switch transistors Md11 to Md1*m*, which are respectively connected in series to one other.

The drains of the individual switch transistors Md11 to Md1*m* are connected to one another so that currents flowing to the drains are summed up. The summed drive current is outputted from an output terminal O1 via a summed drive current switch transistor ME1.

Bypass circuits E11 to E1*m* are respectively provided between the sources of the individual switch transistors Md11 to Md1*m* and a predetermined common voltage Va.

(Detailed Configuration)

The current source transistors Ms11 to Ms1*m* are configured to receive a current source bias voltage Vb at their gates and allow preset drive currents to flow therethrough. To state more specifically, the current source transistors Ms11 to Ms1*m* are respectively composed of transistors of the numbers or sizes increasing by the first to (m−1)th power of 2 times.

The cascode transistors Mc11 to Mc1*m* are configured to receive a cascode bias voltage Vc at their gates and stabilize the drain voltages of the current source transistors Ms11 to Ms1*m*.

The individual switch transistors Md11 to Md1*m* are configured to be turned ON/OFF according to m-bit image signals Vd11 to Vd1*m*, respectively, to give the summed drive current supporting the m-th power of 2 levels of gray scale.

The summed drive current switch transistor ME1 is configured to receive an output enable signal OE at its gate and output the summed drive current at predetermined timing.

Figure 2:
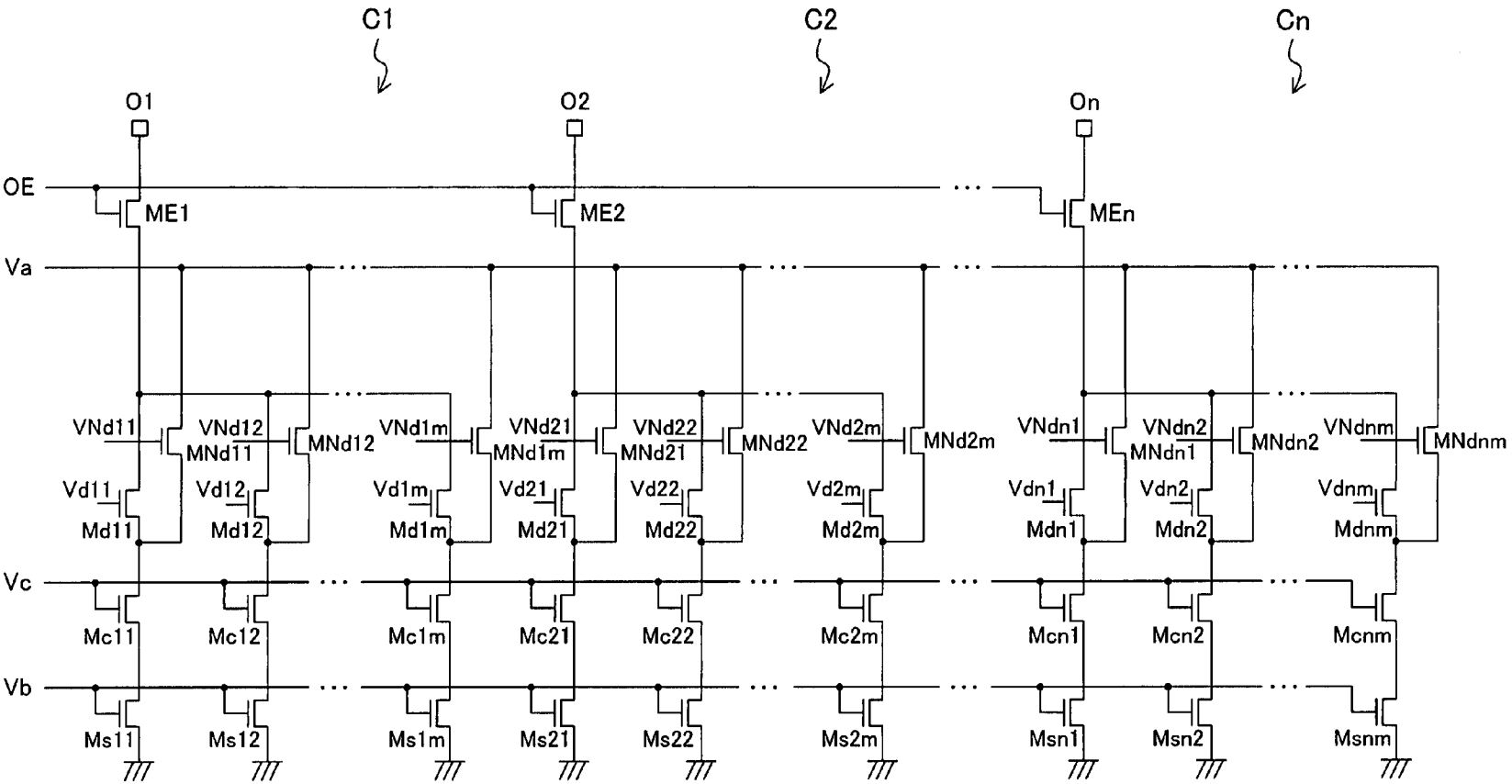
FIG. 2 is a circuit diagram showing a specific configuration of bypass circuits in FIG. 1.

Specifically, the bypass circuits E11 to E1*m* may be composed of bypass transistors MNd11 to MNd1*m* as shown in FIG. 2, for example. The bypass transistors MNd11 to MNd1*m* receive at their gates bypass control signals VNd11 to VNd1*m* obtained by executing NAND operation between the image signals Vd11 to Vd1*m* and the output enable signal OE, respectively. In other words, the bypass transistors MNd11 to MNd1*m* are turned ON when at least either the corresponding individual switch transistors Md11 to Md1*m* or the summed drive current switch transistor ME1 is turned OFF (during the drive current stop period), to divert the currents flowing through the drains of the corresponding cascode transistors Mc11 to Mc1*m* to the bypass transistors MNd11 to MNd1*m*. Contrarily, the bypass transistors MNd11 to MNd1*m* are turned OFF when both the corresponding individual switch transistors Md11 to Md1*m* and the summed drive current switch transistor ME1 are turned ON (during the drive current supply period).

(Operation of Current Drive Device)

The operation of the current drive device configured as described above will be discussed focusing on the individual switch transistor Md11 among the individual switch transistors Md11 to Md1*m*.

When both the individual switch transistor Md11 and the summed drive current switch transistor ME1 are turned ON (during the drive current supply period), a drive current is outputted from the output terminal O1 via the current source transistor Ms11, the cascode transistor Mc11, the individual switch transistor Md11 and the summed drive current switch transistor ME1. The magnitude of this drive current is kept constant with the current source transistor Ms11. Also, with the provision of the cascode transistor Mc11, the drain voltage of the current source transistor Ms11 remains roughly constant. The precision of the drive current is therefore kept at a high level.

When at least either the individual switch transistor Md11 or the summed drive current switch transistor ME1 is turned OFF (during the drive current stop period), the bypass transistor MNd11 is turned ON, allowing the current to flow through the current source transistor Ms11, the cascode transistor Mc11 and the bypass transistor MNd11. With this flow of the bypass current, the drain voltage of the current source transistor Ms11 is suppressed from dropping. The drain voltage is also suppressed from rising with the provision of the cascode transistor Mc11. Hence, once both the individual switch transistor Md11 and the summed drive current switch transistor ME1 are turned ON as described above, the gate voltage Vb of the current source transistor Ms11 is suppressed from varying, ensuring swift output of a high-precision drive current.

The bypass control signals VNd11 to VNd1*m* are not limited to the signals described above obtained by executing NAND operation between the image signals Vd11 to Vd1*m* and the output enable signal OE. For example, in the case that the output enable signal OE is invariably set to be in a low (L) level whenever any of the image signals Vd11 to Vd1*m* is in the L level, signals inverted from the image signals Vd11 to Vd1*m* may be used as the bypass control signals VNd11 to VNd1*m*. To be short, it should only be ensured that a bypass current flows during the drive current stop period and stops flowing during the drive current supply period.

The magnitudes of the bypass currents, that is, the magnitudes of the bypass control signals VNd11 to VNd1*m*, the common voltage Va and the like are not necessarily set so that the drain voltages of the current source transistors Ms11 to Ms1*m* during the drive current supply period are precisely equal to those during the drive current stop period. Instead, these magnitudes may only be set so as to obtain the responsivity and precision corresponding to the requirement specifications of an apparatus to be driven, for example.

Embodiment 2

Figure 3:
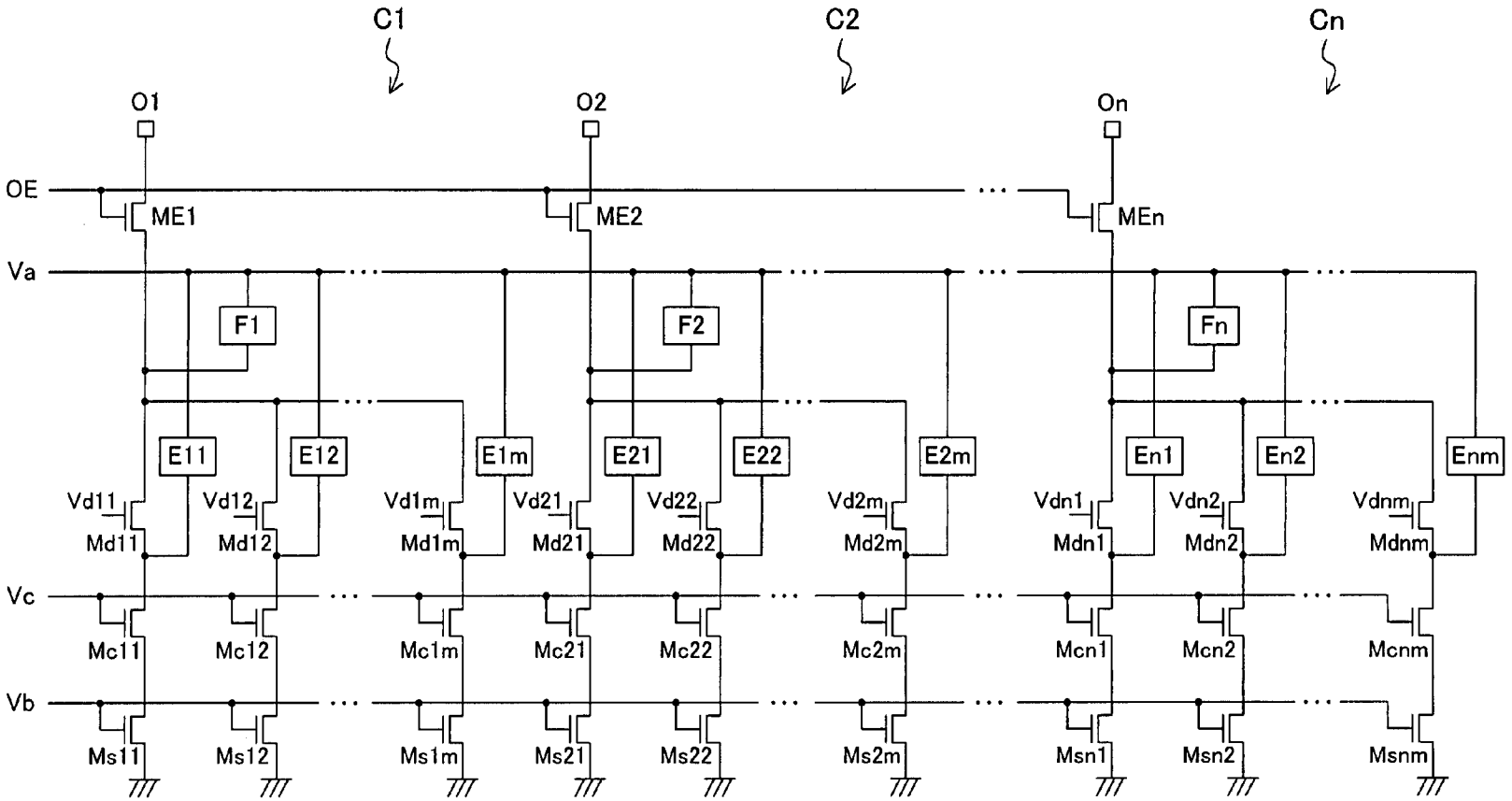
FIG. 3 is a circuit diagram of a current drive device of Embodiment 2.
Figure 4:
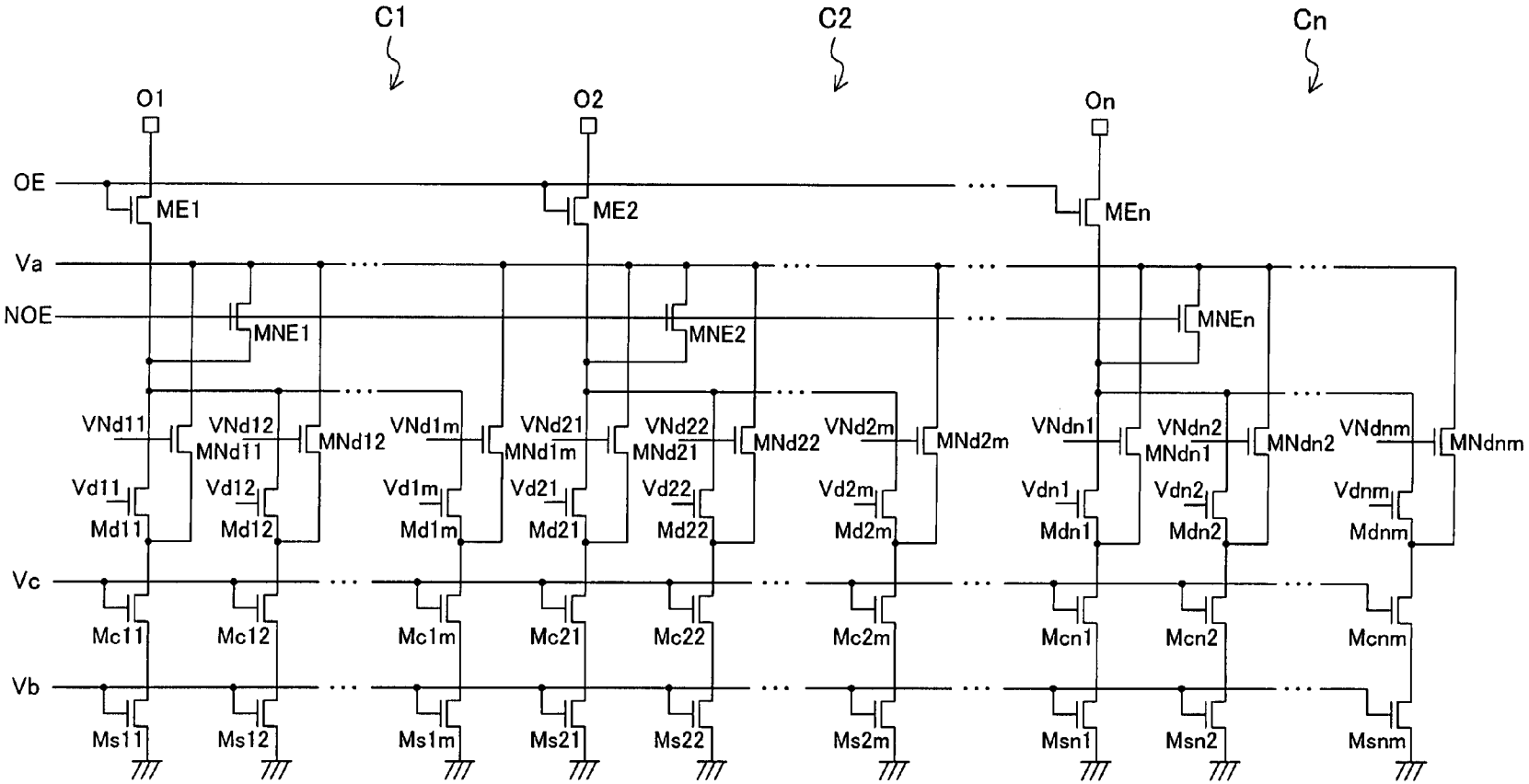
FIG. 4 is a circuit diagram showing a specific configuration of bypass circuits in FIG. 3.

In addition to the components of the current drive device of Embodiment 1, summed drive current bypass circuits F1 to Fn may be provided as shown in FIG. 3, for example. Specifically, the summed drive current bypass circuits F1 to Fn may be respectively composed of summed drive current bypass transistors MNE1 to MNEn as shown in FIG. 4, for example. The gates of the summed drive current bypass transistors MNE1 to MNEn receive a bypass control signal NOE inverted from the output enable is signal OE.

In this embodiment, also, the gates of the bypass transistors MNd11 to MNd1*m* respectively receive the bypass control signals VNd11 to VNd1*m* inverted from the image signals Vd11 to Vd1*m*.

In the current drive device of this embodiment, when the individual switch transistor Md11 is turned OFF, the bypass transistor MNd11 is turned ON (irrespective of ON/OFF of the summed drive current switch transistor ME1), diverting a current flowing through the drain of the cascode transistor Mc11 to the bypass transistor MNd11. Hence, as in Embodiment 1, the drain voltage of the current source transistor Ms11 remains roughly constant.

When the summed drive current switch transistor ME1 is turned OFF, the summed drive current bypass transistor MNE1 is turned ON even if the individual switch transistor Md11 is ON, diverting a current flowing through the drain of the individual switch transistor Md11 to the summed drive current bypass transistor MNE1. In this case, also, the drain voltage of the current source transistor Ms11 remains roughly constant.

Thus, in this embodiment, the control signals used are obtained by inverting the image signals Vd11 to Vd1*m* and the output enable signal OE without the necessity of executing NAND operation between these signals as in Embodiment 1. Hence, a control signal generation circuit can be simplified.

Embodiment 3

Figure 5:
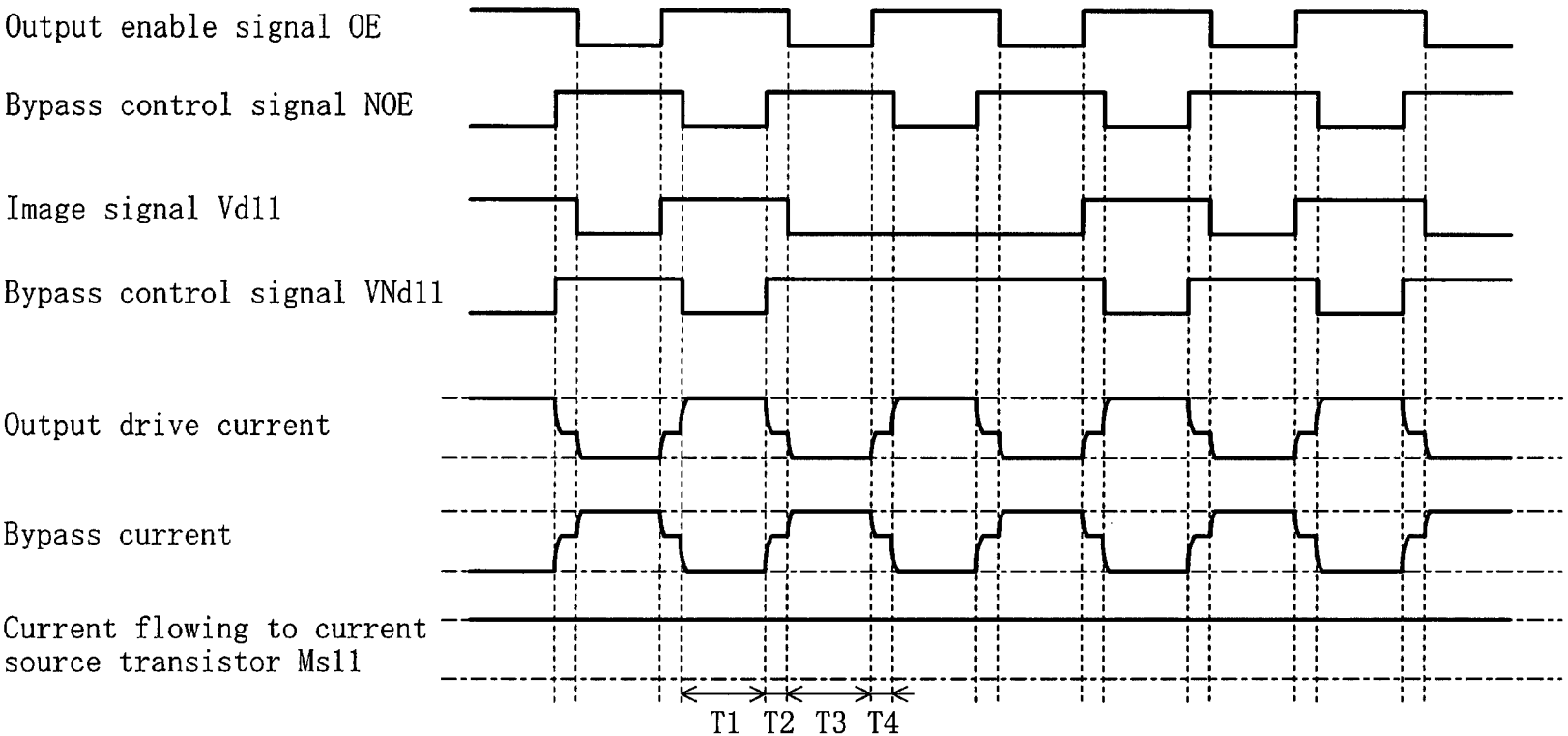
FIG. 5 is a timing chart showing signals for various portions of a current drive device of Embodiment 3.

In the configuration of Embodiment 2, the bypass control signal NOE and the bypass control signals VNd11 to VNd1*m* may otherwise have waveforms as shown in FIG. 5 with respect to the output enable signal OE and the image signals Vd11 to Vd1*m*, respectively. More specifically, the bypass control signal NOE is in a high (H) level, not is only during a period T3 when the output enable signal OE is in a low (L) level, during which the summed drive current switch transistor ME1 is OFF, but also during predetermined overlap periods T2 and T4 preceding and following the period T3. This also applies to the bypass control signals VNd11 to VNd1*m*. That is, although the image signals Vd11 to Vd1*m* may be in the L level over consecutive periods depending on the image data, the overlap period T2 or T4 is provided every time the level shifts.

During the overlap periods T2 and T4 in which both the output enable signal OE and the bypass control signal NOE and both the image signals Vd11 to Vd1*m* and the corresponding bypass control signals VNd1 to VNd1*m* are in the H level, the output drive current may decrease by the amount of the bypass current flowing to the corresponding bypass transistors MNd11 to MNd1*m* and the summed drive current bypass transistor MNE1. This will however cause no problem as long as the length of these overlap periods T2 and T4 and the decrease amount of the drive current are set to be within the respective ranges in which the operation of a circuit to be driven will not be affected.

By providing the overlap periods T2 and T4 as described above, the currents flowing to the current source transistors Ms11 to Ms1*m* will not be discontinued, and thus the temporary drop of the drain voltage can be reliably suppressed.

In place of providing the overlap periods during which both the output enable signal OE and the bypass control signal NOE and both the image signals Vd11 to Vd1*m* and the corresponding bypass control signals VNd11 to VNd1*m* are in the H level as described above, periods during which both the output enable signal OE and the bypass control signal NOE and both the image signals Vd11 to Vd1*m* and the corresponding bypass control signals VNd11 to VNd1*m* are in the L level may be provided depending on the requirement specifications of a circuit to be driven and the response characteristics of the current source transistors Ms11 to Ms1*m*. It should be noted that the above description is for the case of using n-channel transistors for the MISFETs. In the case of using p-channel transistors, the H and L levels in the above description should be reversed.

The above configuration may also be applied to the device of Embodiment 1.

Embodiment 4

Figure 6:
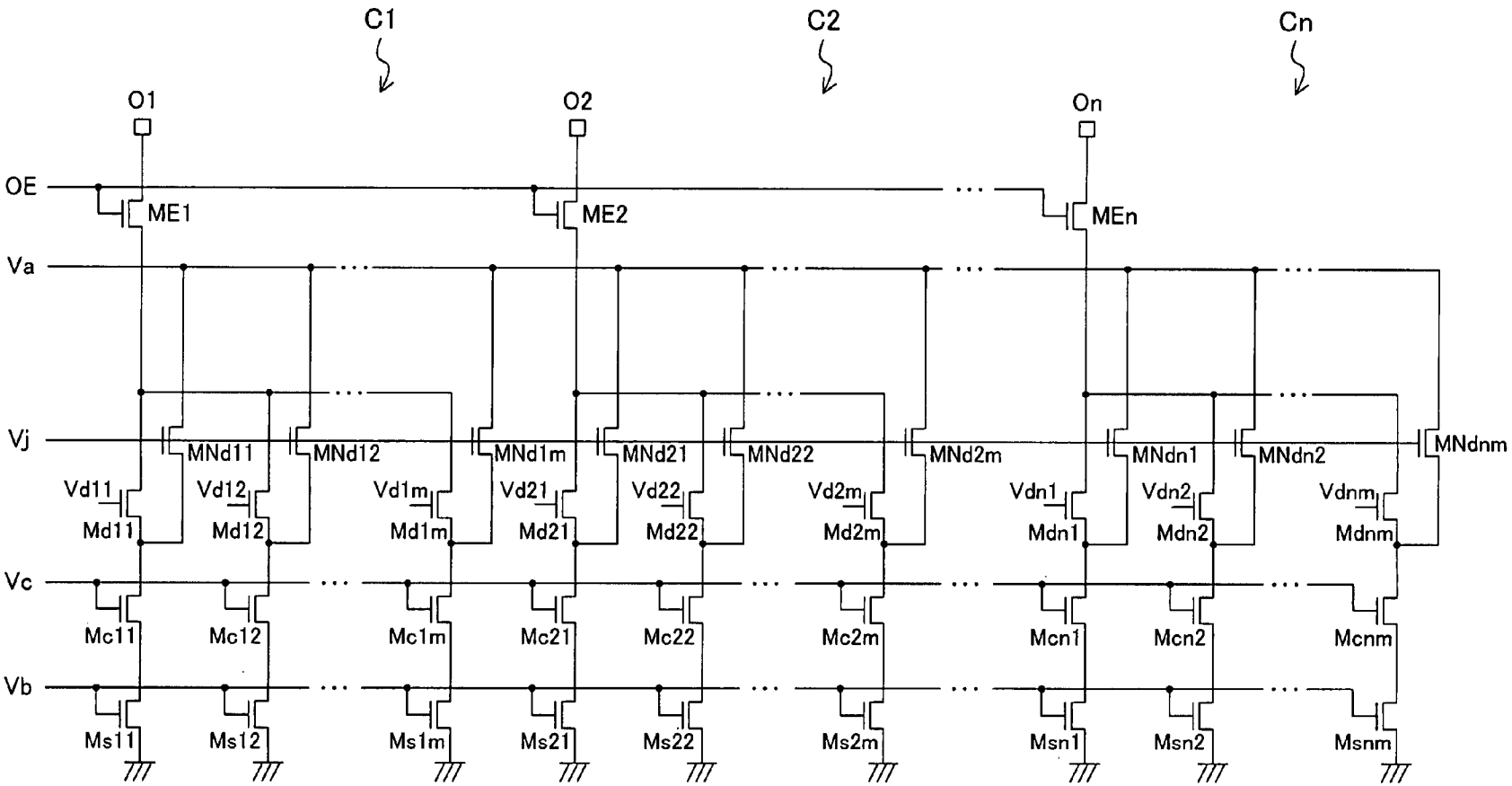
FIG. 6 is a circuit diagram of a current drive device of Embodiment 4.

In a current drive device of Embodiment 4, a fixed bias voltage Vj is applied to the gates of the bypass transistors MNd11 to MNd1*m* as shown in FIG. 6, in place of the bypass control signals VNd11 to VNd1*m* as in Embodiment 1 (FIG. 2). The fixed bias voltage Vj is set so that the bypass transistors MNd11 to MNd1*m* are OFF during the drive current supply period (when a current is flowing through the corresponding transistors Md11 to Md1*m*) and ON during the drive current stop period (when a current is not flowing through the corresponding transistors Md11 to Md1*m*). Also, the cascode transistors Mc11 to Mc1*m* are set to be ON in either case. That is, the fixed bias voltage Vj is set to have a voltage equal to the source voltage of the bypass transistors MNd11 to MNd1*m* given during the drive current supply period, for example. To state more specifically, the fixed bias voltage Vj is set to be lower than the source voltage of the bypass transistors MNd11 to MNd1*m* given during the drive current supply period+threshold voltage and equal to or higher than the source voltage of the bypass transistors MNd11 to MNd1*m* given during the drive current stop period+threshold voltage.

By configuring as described above, the bypass current can be made to flow during the drive current stop period and stop flowing during the drive current supply period without the necessity of generating the bypass control signals VNd11 to VNd1*m* particularly.

In the above embodiments, m individual switch transistors Md11 to Md1*m* switching between ON/OFF according to the m-bit image signals Vd11 to Vd1*m* were provided. The present invention is not limited to this, but configurations as described above can also be applied to current drive devices used for displaying a binary image using one individual switch transistor and for displaying a multilevel image by controlling the ON time of the transistor.

The switching configuration is not limited to that described above composed of the individual switch transistors Md11 to Md1*m* and the summed drive current switch transistor ME1, but any switch circuit that can switch ON/OFF output of the drive current by some measures or other may just be provided.

In the above embodiments, the bypass transistors MNd11 to MNd1*m* were connected to the drains of the cascode transistors Mc11 to Mc1*m* to bypass the current. Alternatively, the bypass transistors MNd11 to MNd1*m* may be connected to the drains of the current source transistors Ms11 to Ms1*m*. In this case, the gate voltage for turning ON the bypass transistors MNd11 to MNd1*m* may be set at a voltage equal to the cascode bias voltage Vc for the cascode transistors Mc11 to Mc1*m*, or an equivalent voltage according to the size and characteristics of the transistors.

In the embodiments described above, the current drive device that sucks in a current via the output terminal O1 was exemplified. Likewise, a current drive device that discharges a current can also be provided in a similar manner.

While the present invention has been described in preferred embodiments, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A current drive device comprising:

a current source transistor for allowing a preset drive current to flow to a drain;

a cascode transistor cascode-connected to the current source transistor;

a switch circuit for switching ON/OFF flow of the drive current through a drain of the cascode transistor and a circuit to be driven; and a bypass circuit for allowing the drive current to flow therethrough to bypass the switch circuit and the circuit to be driven when the switch circuit is OFF, wherein the bypass circuit comprises a bypass transistor connected to the drain of the cascode transistor at its source and receiving a predetermined fixed gate voltage at its gate, and the predetermined fixed gate voltage is set so that the bypass transistor is ON with respect to a source voltage given when the switch circuit is OFF and OFF with respect to a source voltage given when the switch circuit is ON.

2. A current drive device comprising:

a current source transistor for allowing a preset drive current to flow to a drain;

a cascode transistor cascode-connected to the current source transistor;

a switch circuit for switching ON/OFF flow of the drive current through a drain of the cascode transistor and a circuit to be driven; and a bypass circuit for allowing the drive current to flow therethrough to bypass the switch circuit and the circuit to be driven when the switch circuit is OFF, wherein a plurality of current source transistors are provided, the switch circuit comprises individual switch transistors provided for the respective current source transistors for selectively switching ON/OFF flow of drive currents to the current source transistors, the bypass circuit comprises a plurality of individual bypass transistors corresponding to the current source transistors, and the currents flowing through the individual switch transistors are summed to be outputted as a summed drive current.

3. The current drive device of claim 2, further comprising a summed drive current switch transistor for switching ON/OFF flow of the summed drive current.

4. The current drive device of claim 3, wherein each of the individual bypass transistors is turned ON when at least either the corresponding individual switch transistor or the summed drive current switch transistor is turned OFF.

5. The current drive device of claim 3, wherein the bypass circuit further comprises a summed drive current bypass transistor for allowing the summed drive current to flow therethrough to bypass the summed drive current switch transistor and a circuit to be driven, the individual bypass transistors are turned ON when the corresponding individual switch transistors are turned OFF, and the summed drive current bypass transistor is turned ON when the summed drive current switch transistor is turned OFF.

* * * * *